US007357453B2

(12) United States Patent
Wu

(10) Patent No.: US 7,357,453 B2
(45) Date of Patent: Apr. 15, 2008

(54) CHAIR WITH ARMRESTS

(76) Inventor: Wenjin Wu, 21E, Li Jing Ge, Bei Xiu Garden, Xiao Bei Road, Guangzhou (CN) 510045

( * ) Notice: Subject to any disclaimer, the term of this patent is extended or adjusted under 35 U.S.C. 154(b) by 0 days.

(21) Appl. No.: 11/739,191

(22) Filed: Apr. 24, 2007

(65) Prior Publication Data

US 2007/0188003 A1 Aug. 16, 2007

Related U.S. Application Data

(63) Continuation-in-part of application No. 11/563,013, filed on Nov. 23, 2006, which is a continuation-in-part of application No. PCT/CN2005/000973, filed on Jul. 4, 2005.

(30) Foreign Application Priority Data

Jan. 24, 2006 (CN) ..... 2006 1 0033298
Dec. 5, 2006 (CN) ..... 2006 1 0124064

(51) Int. Cl.
*A47C 7/46* (2006.01)

(52) U.S. Cl. ..... 297/284.8; 297/230.14; 297/383

(58) Field of Classification Search ..... 297/27, 297/28, 284.8, 360, 383, 411.41, 230.14
See application file for complete search history.

(56) References Cited

U.S. PATENT DOCUMENTS 3,059,971 A * 10/1962 Becker ..... 297/353
4,674,793 A * 6/1987 Kettler ..... 297/28
5,067,187 A * 11/1991 Messina ..... 297/383
5,344,216 A * 9/1994 Suominen ..... 297/383
5,599,066 A * 2/1997 Chih ..... 297/383
6,502,899 B2 * 1/2003 Tseng ..... 297/28
7,125,076 B2 * 10/2006 Beranek et al. ..... 297/283.3
7,222,920 B1 * 5/2007 Washington ..... 297/383

* cited by examiner

*Primary Examiner*—Peter R. Brown
(74) *Attorney, Agent, or Firm*—Matthias Scholl P.C.; Matthias Scholl

(57) ABSTRACT

This invention teaches a chair comprising a seat; a backrest; a first armrest; a second armrest; a seat support structure; means for supporting the lower back of a seated person; a first slider; a second slider; a first slideway having a plurality of cavities; and a second slideway having a plurality of cavities, wherein the first slider and the second slider are disposed at two opposite ends of the means for supporting the lower back of a seated person; the first slideway is cooperating with the first slider and is connected to the first armrest; and the second slideway is cooperating with the second slider and is connected to the second armrest.

14 Claims, 7 Drawing Sheets

CHAIR WITH ARMRESTS

CROSS-REFERENCE TO RELATED APPLICATIONS

This application is a continuation-in-part of U.S. Ser. No. 11/563,013 filed Nov. 23, 2006, now pending, which claims priority benefits to Chinese Patent Application No. 200610033298.1 filed Jan. 24, 2006, and is a continuation-in-part of International Patent Application No. PCT/CN2005/000973 with an international filing date of Jul. 4, 2005, designating the United States, now pending. This application further claims priority benefits to Chinese Patent Application No. 200610124064.8 filed on Dec. 5, 2006. The contents of all of the aforementioned specifications are incorporated herein by reference.

BACKGROUND OF THE INVENTION

1. Field of the Invention

The invention relates to chairs and accessories thereof, and particularly to chairs and armrests thereof.

2. Description of the Related Art

Chinese Patent Application Publication No. CN1806719A and PCT Patent Application Publication No. WO/2007/003070 disclose a chair having a support element, and armrests capable of securing the support element. As hooks disposed on the support element are inserted into different cavities of the armrests, the position of the support element is changed with respect to the armrests, and support to the lower back of a seated person in different sitting postures is provided. However, inserting hooks into armrest cavities may be inconvenient or difficult for a seated person who may need to stand up to perform the desired adjustments.

SUMMARY OF THE INVENTION

In view of the above-described problem, it is one objective of the invention to provide a chair having an armrest for allowing a seated person to flexibly adjust a support element according to the seated person's requirements.

In accordance with one embodiment of the invention, provided is a chair comprising a seat; a backrest; a first armrest; a second armrest; a seat support structure; means for supporting the lower back of a seated person; a first slider; a second slider; a first slideway having a plurality of cavities; and a second slideway having a plurality of cavities.

In a class of this embodiment, the first slider and the second slider are disposed at two opposite ends of the means for supporting the lower back of a seated person.

In another class of this embodiment, the first slideway is cooperating with the first slider and is connected to the first armrest; and the second slideway is cooperating with the second slider and is connected to the second armrest.

In another class of this embodiment, the plurality of cavities is capable of receiving the means for supporting the lower back of a seated person.

In another class of this embodiment, the first slider is movably connected to the first slideway and the second slider is movably connected to the second slideway.

In another class of this embodiment, the means for supporting the lower back of a seated person is a flexible support element capable of being moved with respect to the first and/or the second armrest.

In another class of this embodiment, the first slider and the second slider comprise each a block capable of sliding along the slideways, a pair of protrusions is disposed at two opposite sides of the block, and a through hole and a fixing hole are oppositely formed in the block between the protrusions.

In another class of this embodiment, a pair of grooves for movably receiving the protrusions is disposed on two opposite sides of the slideways enabling the sliders to slide forwardly and backwardly therein.

In another class of this embodiment, a gap is disposed at a front end of each the groove allowing the sliders to be detached from the first and the second armrests.

In another class of this embodiment, the slider further comprises a controlling portion for controlling the block, the controlling portion comprising a bolt; a dowel extending from the bolt; and a tilting member connected to the bolt.

In another class of this embodiment, the dowel is inserted into the through hole on the block, and further into the cavities on the armrests, and the tilting member allows for attaching/detaching the dowel to/from the cavities.

In another class of this embodiment, the slider further comprises a spring, an upper cover and a pressing portion.

In another class of this embodiment, the spring is mechanically-connected between the control portion and the upper cover.

In another class of this embodiment, an opening is disposed on the upper cover for receiving the tilting member and/or the pressing portion.

In another class of this embodiment, one side of the pressing portion abuts against the tilting member via the spring.

In another class of this embodiment, the slider further comprises a driving portion disposed at the other side of the pressing portion.

In another class of this embodiment, the driving portion comprises a metal sleeve abutting against the pressing portion; and a rope sleeve movably mounted on the metal sleeve and mechanically-connected to the support element, for pressing the pressing portion into the opening of the upper cover.

In another class of this embodiment, the driving portion further comprises a screw traversing through the metal sleeve, the pressing portion, the upper cover and the control portion to fasten the metal sleeve to the block.

In another class of this embodiment, the armrests further comprise inclined planes disposed in proximity of the cavities, for preventing the sliders from moving backwardly.

In a second embodiment, this invention provides an armrest for a chair having a support element, comprising a slideway; a groove; and a plurality of cavities.

In a class of this embodiment, the slideway is connected to the armrest; the groove is disposed on the slideway for enabling the support element to slide forwardly and backwardly therein; and the cavities are disposed in the slideway for fixing the support element at different positions.

In another class of this embodiment, the armrest further comprises a plurality of inclined planes disposed in proximity of the cavities.

In another class of this embodiment, the armrest further comprises a plurality of inclined planes for preventing the support element from moving backwardly, the inclined planes being disposed in front of all but the foremost one cavity.

DETAILED DESCRIPTION OF THE INVENTION

Figure 1:
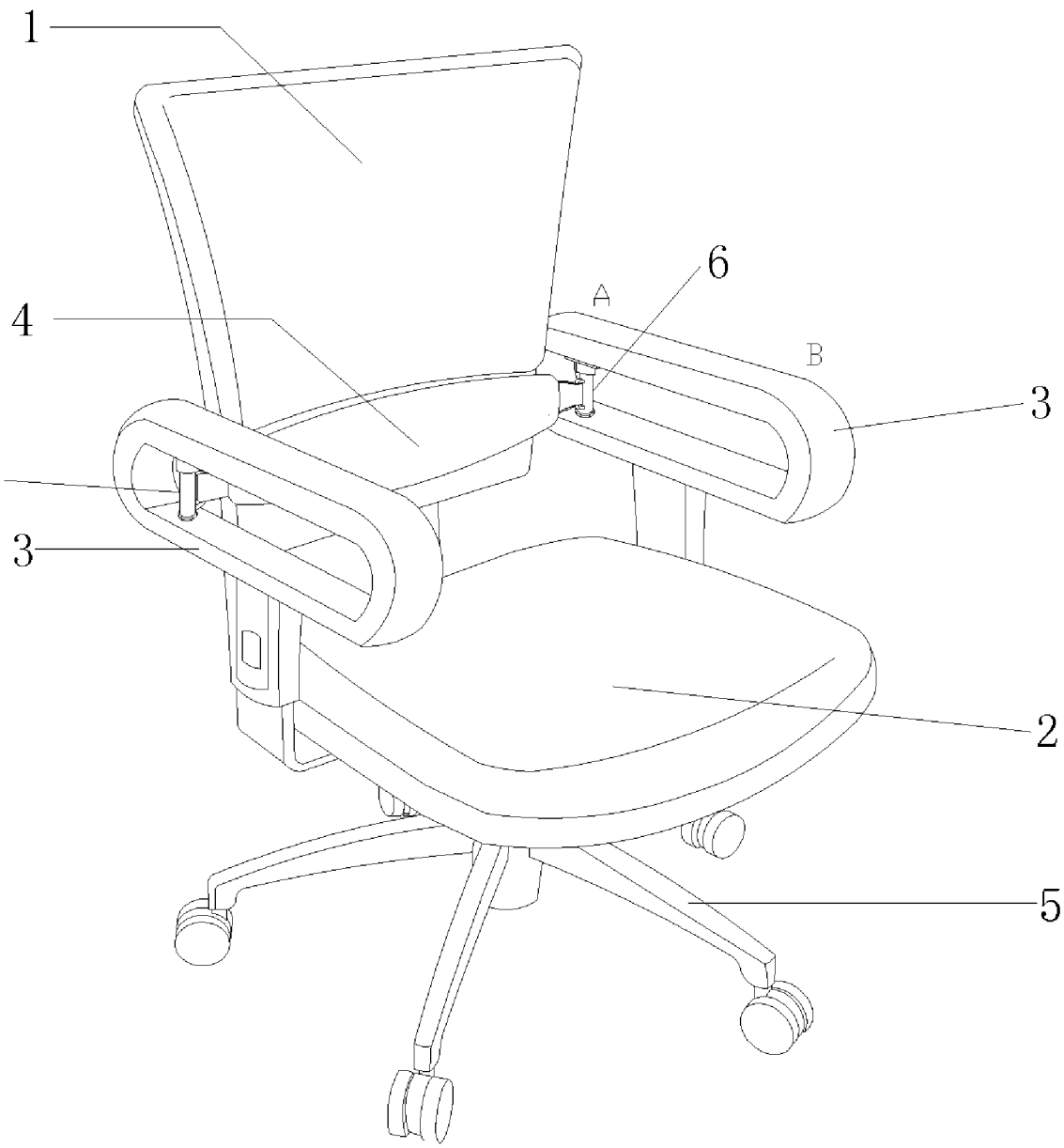
FIG. 1 is a perspective view of a chair in accordance with the invention.

As shown in FIG. 1, a chair in accordance with the invention comprises a backrest 1, a seat 2, a pair of armrests 3, a support element 4, a support structure 5 and a pair of sliders 6. The support element 4 is, e.g., a flexible support element in the shape of strip or band or rope, and both ends of the support element 4 are mechanically-connected to the armrests 3 via the sliders 6.

The flexible characteristics of the support element allow it to assume the shape of the lower back of a seated person using the chair. This is to say that the support element wraps around and adjusts to the contours of the lower back of a seated person using the chair in a manner similar to that of a belt worn around a person's waist.

Figure 2:
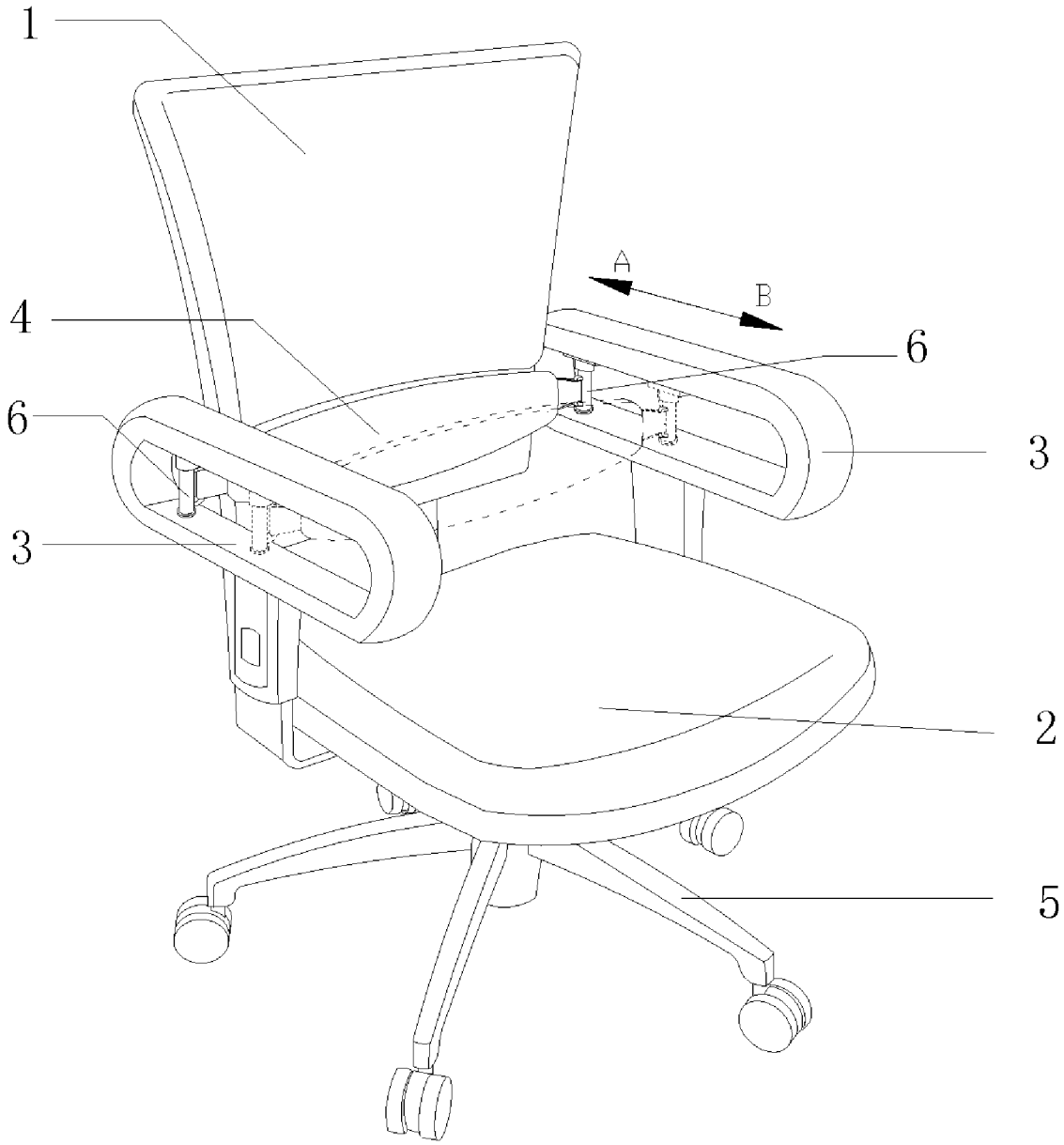
FIG. 2 is a perspective view of a chair in accordance with the invention showing the support element in two positions, A and B.

As shown in FIG. 2, as the support element 4 is movable forward (to position marked B) and backward (to position marked A), wherein the sliders 6 allow the support element 4 to slide along one dimension of each of the armrests 3.

Figure 3A:
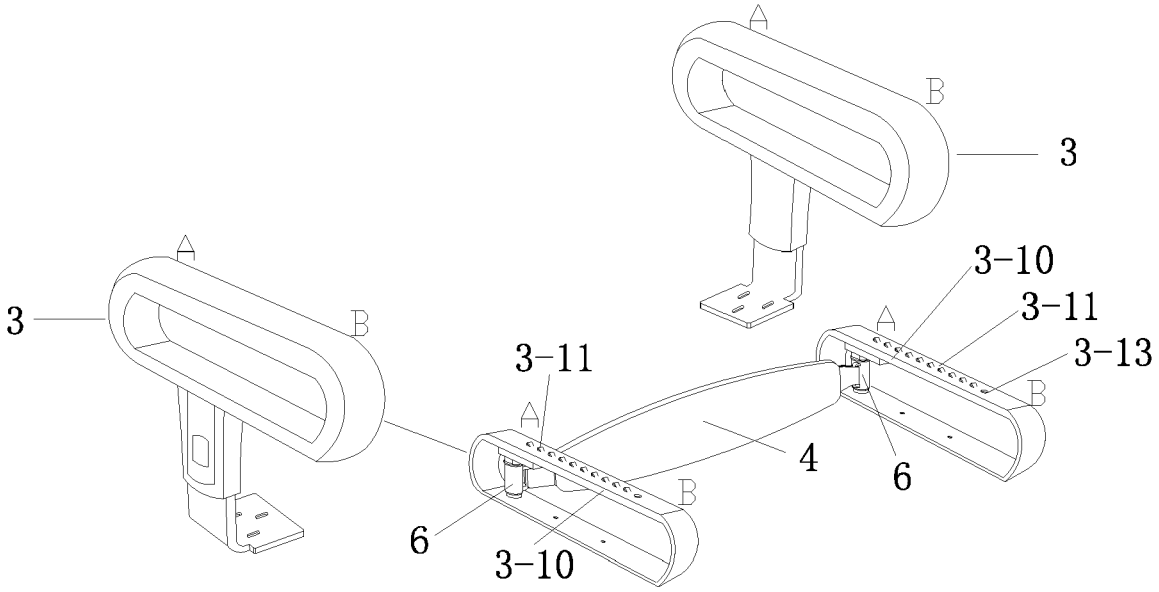
FIG. 3A is an exploded view of the armrests, the slideways, and the support element in accordance with one embodiment of the invention.
Figure 3B:
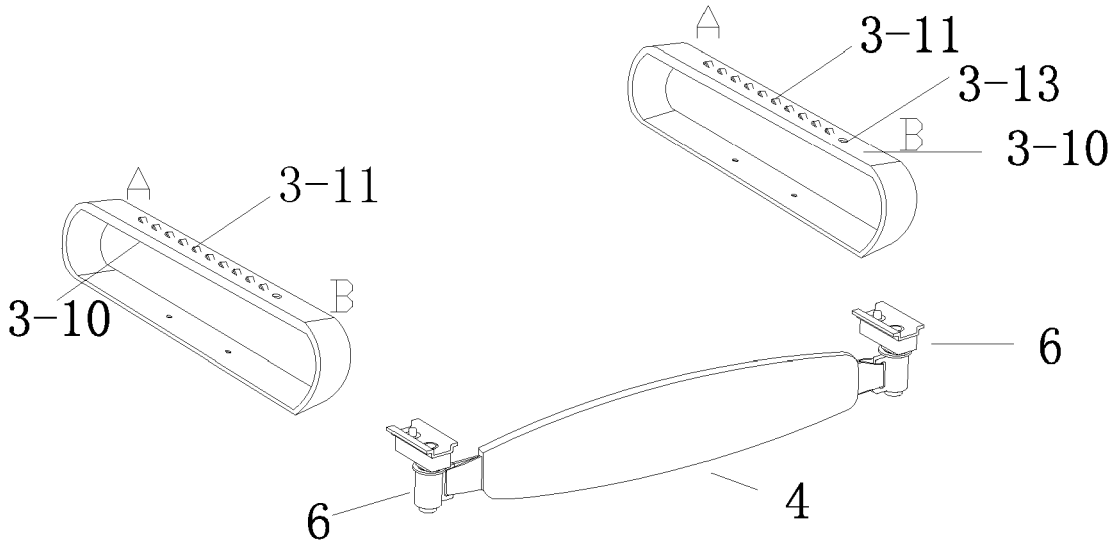
FIG. 3B is an exploded view of the slideways and the support element in accordance with one embodiment of the invention.
Figure 4:
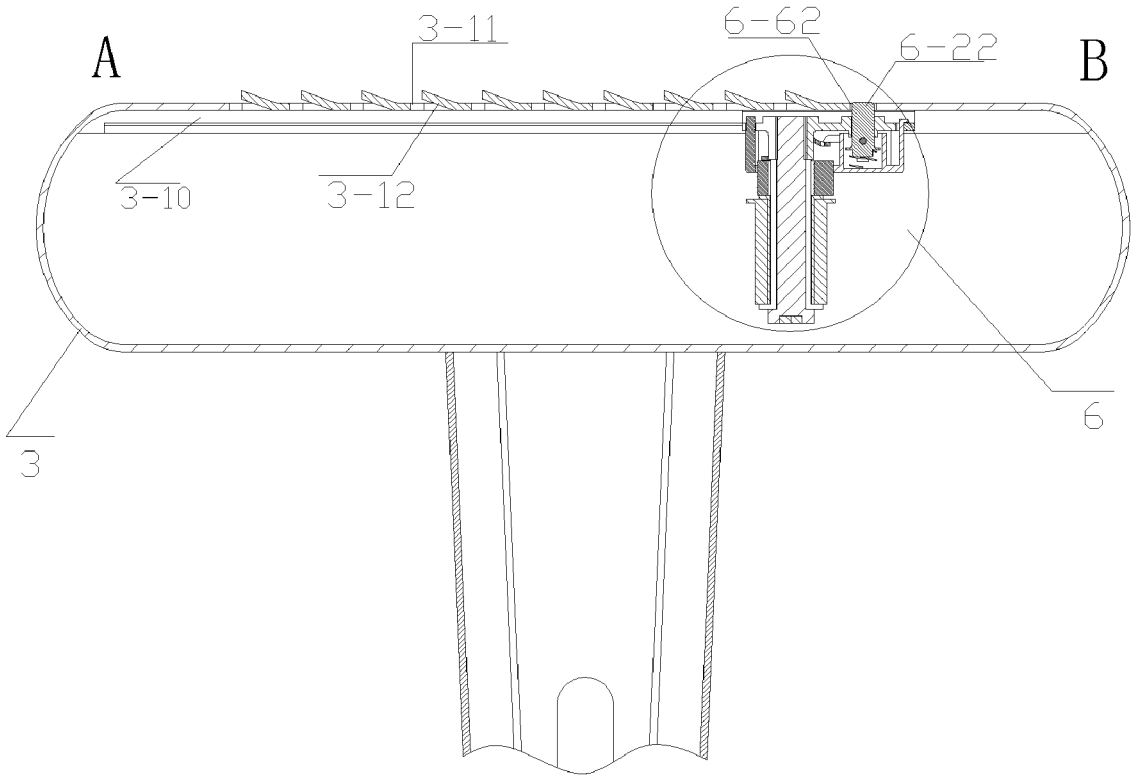
FIG. 4 is a cross-sectional view of a slideway cooperating with a slider in accordance with one embodiment of the invention.

As shown in FIGS. 2-4, one slideway 3-10 is connected to one of the armrests 3, and another slideway 3-10 is connected to a second armrest 3. The slideways 3-10 comprise each an upper plane and a lower plane joined with one another by two arcuate pieces. In certain embodiments, the armrests 3 each comprise a cavity in the shape of the slideways 3-10 allowing the slideways 3-10 to be inserted into the armrests 3 for a secure fit. Many other various shapes for the armrests 3 and the slideways 3-10 can be envisioned, wherein the upper and lower planes of the slideways are or are not substantially parallel to each other.

The sliders 6 disposed at the two opposite sides of the support element 4 are movably received in the slideways 3-10, so as to enable the sliders 6 to slide forwardly and backwardly therein with respect to the backrest 1. A plurality of cavities 3-12 are disposed on the slideways 3-10 so as to receive dowels 6-22 of the sliders 6, making it possible for the support element 4 to move backwards along with a seated person, and thus to support the lower back of the person.

Figure 5:
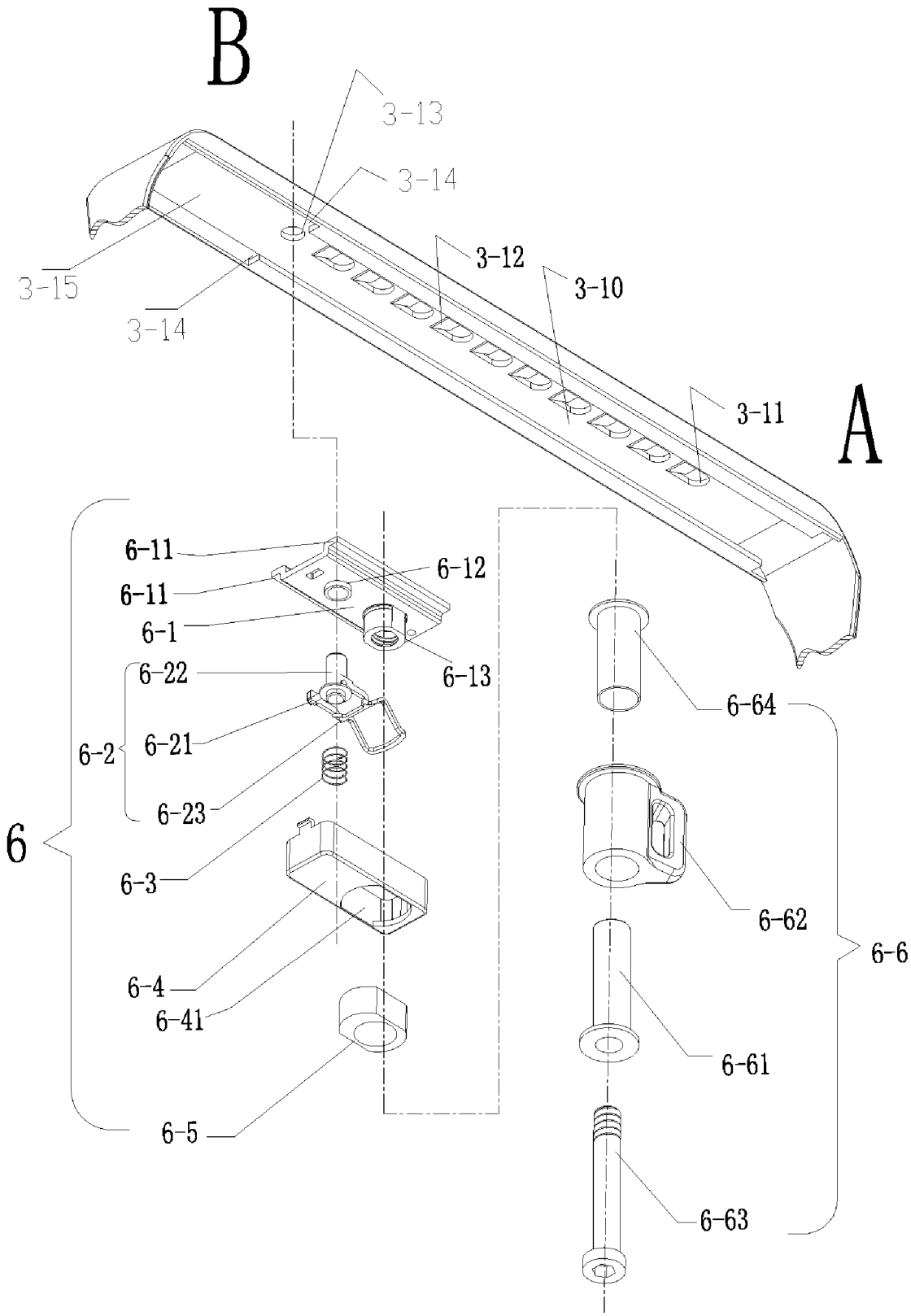
FIG. 5 is an exploded view of a slideway and a slider in accordance with one embodiment of the invention.

As shown in FIG. 5, a pair of grooves 3-14 is disposed on two opposite sides of the slideways 3-10, so as to movably receive a pair of protrusions 6-11 of the sliders 6. A plurality of cavities 3-11 is disposed on the slideways 3-10, so as to fasten a pair of dowels 6-22 of the sliders 6.

Figure 7:
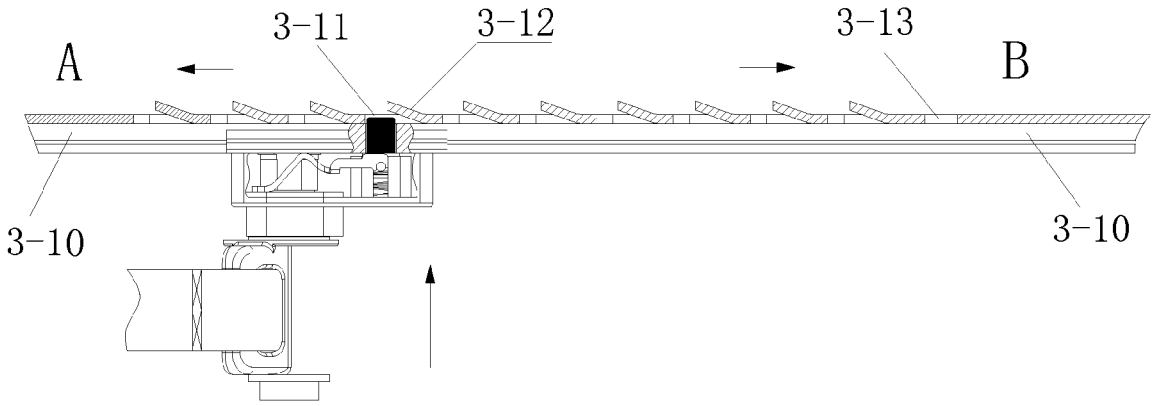
FIG. 7 is a cross-sectional view of a slideway cooperating with a slider in accordance with one embodiment of the invention.

As shown in FIGS. 5 and 7, a plurality of inclined planes 3-12 is disposed in front of all cavities 3-11 except for the first cavity 3-13, which prevents the sliders 6 from moving backwards out of their normal sliding range. Since no inclined plane is disposed in front of the foremost cavity 3-13, the foremost cavity 3-13 is capable of preventing the sliders 6 from moving forwards and backwards past it.

A gap 3-15 is disposed at the front end of the grooves 3-14 so as to detach/attach said sliders 6 from/to the armrests 3.

The armrest 3 comprises a slideway 3-10, a plurality of cavities 3-11, a plurality of inclined planes 3-12 disposed in front of all cavities 3-11 except for the most forward-placed cavity 3-13, a pair of grooves 3-14 disposed on two opposite sides of the slideway 3-10, and a gap 3-15 disposed at the front end of the grooves 3-14. The gap 3-15 is disposed at the front end of the grooves 3-14 so as to detach/attach said sliders 6 from/to the armrests 3.

Figure 6:
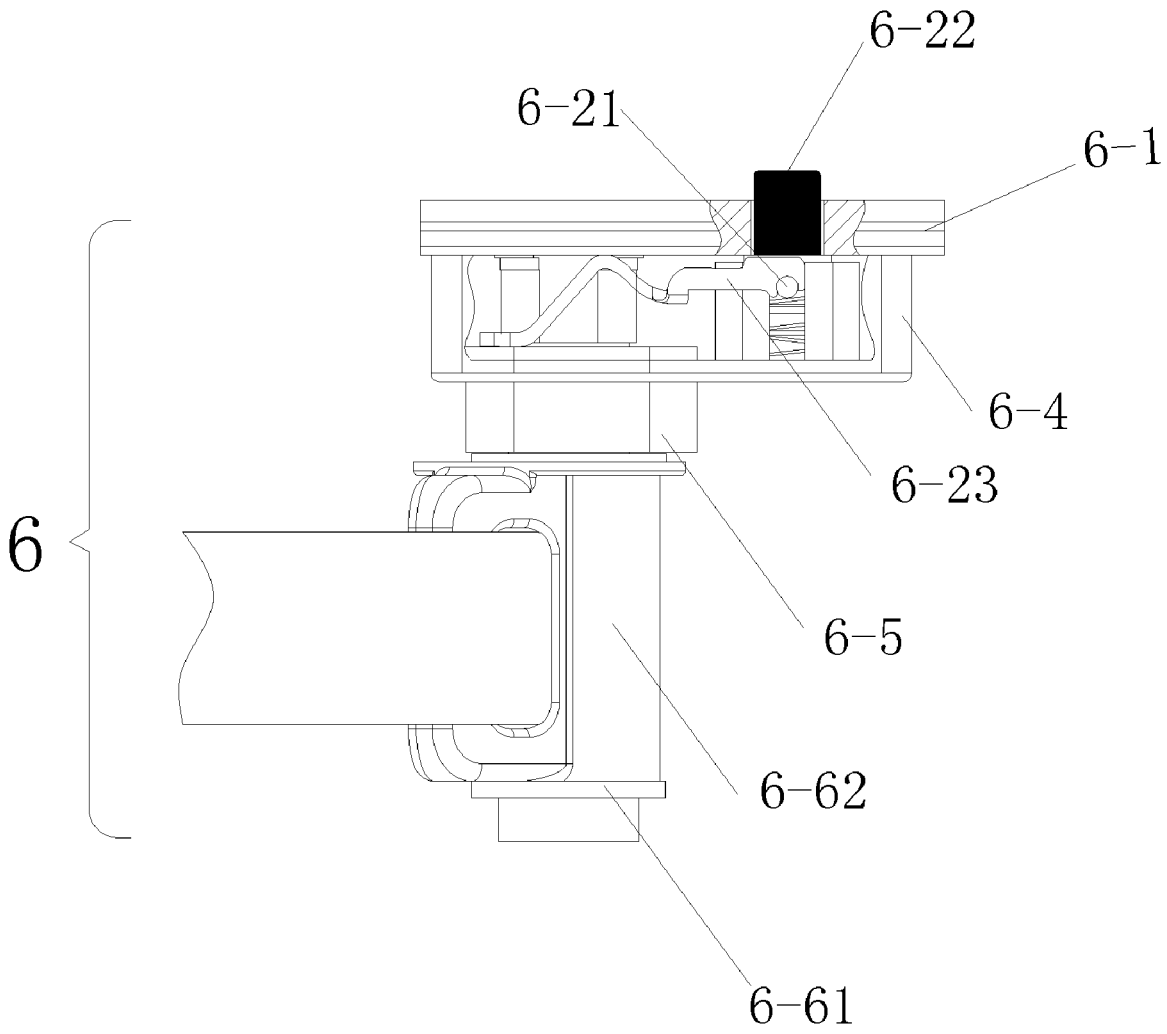
FIG. 6 is a cross-sectional view of a slider in accordance with one embodiment of the invention.

As shown in FIGS. 5 and 6, the slider 6 comprises a block 6-1, a control portion 6-2, a spring 6-3, an upper cover 6-4, a pressing portion 6-5 and a driving portion 6-6. The block 6-1 comprises a pair of protrusions 6-11 disposed at two opposite sides thereof, and a through hole 6-12 and a fixing hole 6-13 disposed longitudinally on the opposite sides of the sliders 6 between the protrusions 6-11. Each protruding portion 6-11 is movably received in the groove 3-14 so as to enable the slider 6 to slide forwardly and backwardly therein.

The control portion 6-2 comprises a bolt 6-21, a dowel 6-22 extending from the bolt 6-21 and a tilting member 6-23 connected to the bolt 6-21. The dowel 6-22 is inserted into the through hole 6-12 on the block 6-1, and further into the cavities 3-12 on the armrests 3. The tilting member 6-23 is for placing/detaching the dowel 6-21 into/from the cavities 3-12.

The spring 6-3 is mechanically-connected between the control portion 6-2 and the upper cover 6-4. An opening is 6-41 disposed on the upper cover 6-4 for receiving the tilting member 6-23 and/or the pressing portion 6-5. One side of the pressing portion 6-5 abuts against the tilting member 6-23 via the spring 6-3.

The driving portion 6-6 includes a metal sleeve 6-61, a rope sleeve 6-62, a screw 6-63 and a plastic sleeve 6-64. The metal sleeve 6-61 abuts against the pressing portion 6-5. The rope sleeve 6-62 is movably mounted on the metal sleeve

6-61 and mechanically-connected to the support element 4, for pressing the pressing portion 6-5 into the opening 6-41 of the upper cover 6-4.

The screw 6-63 traverses through the metal sleeve 6-61, the pressing portion 6-5, the upper cover 6-4 and the control portion 6-2, so as to fasten the metal sleeve 6-61 to the block 6-1. The plastic sleeve 6-64 is inserted into the inner wall of the metal sleeve 6-61.

FIG. 7 is a cross-sectional view of the slideway 3-10 cooperating with the slider 6 in accordance with one embodiment of the invention. In use, the sliders 6 disposed at the opposite sides of the support element 4 are fastened to different cavities 3-11 on the slideways 3-10, and it thus enable a seated person to flexibly adjust the support element 4 according to the person's requirements while in a seated position and with the need to stand up to accomplish the desired adjustments. The seated person only needs to push the pressing portion 6-5 to move the sliders 6 forward as he/she wishes to move forward the support element 4.

If the seated person wishes to move backward the support element 4, he/she needs to push upward the rope sleeves 6-62 on the sliders 6, the tilting member 6-23 will correspondingly move upward and drive the dowels 6-22 to move downward and detach from one of the cavities 3-11; at this point the support element 4 may move backward.

If a seated person wishes to fasten the support element 4 to a certain position on the armrests 3, firstly the sliders 6 are moved to the required position, under pressure of the springs 6-3, the dowels 6-22 are pushed upward and inserted into a cavity 3-11 corresponding to the required position. If a seated person wishes to detach the support element 4 from the armrest 3, he/she may move the slider 6 to the gap 3-15 disposed at the front end of armrest 3, and the slider 6 will detach from the slideways 3-10.

In certain embodiments of the invention, the support element 4 of the invention is a ductile leather belt or a knitted belt, or the like.

The term "elongated," as used herein and as referring to a support element means that the length of such support element is much larger than its width under normal conditions. For example, the ratio of length to width of an elongated element is from about 40:1 to about 5:1, and preferably from about 20:1 to about 10:1. For example, an elongated in shape support element is a belt, a strip, a band or a rope.

As used herein, the term "rope" means a length of strong and stout line or cordage, usually made of twisted strands of hemp, flax, or other fibrous material, but also of strips of hide, pliant twigs, metal wire, etc.

As used herein, the term "belt" means a broadish, flat strip of material, in other contexts used to gird or encircle the person, confine some part of the dress, and to support various articles of use or ornament.

As used herein, the term "strip" means a narrow piece (primarily of textile material, or the like) of approximately uniform breadth.

As used herein, the term "band" means a string, a strap, or a chain. As used herein, the term "string" is meant to include a line, cord, or thread. As used herein, the term "strap" is meant to include a line, a cord, or a thread.

As used herein, the term "chain" means a connected series of links (of material) passing through each other, or otherwise jointed together, so as to move on each other more or less freely, and thus form a strong but flexible ligament or string.

As used herein, and as referring to a support element, the term "flexible" means capable of being bent, admitting of change in figure without breaking; yielding to pressure, pliable, pliant, and not rigid. This property allows the support element to mould to the lower back of a seated person, i.e., to fit closely to the lower back of a seated person so as to provide support. This is not to say, however, that the support element is capable of being longitudinally stretched, dilated, or distorted by external force to a great extent in a direction parallel to its surface without braking, or that it spontaneously resumes its normal bulk or shape after having been contracted, dilated, or distorted by external force.

The support element is made, for example and without limitation, of leather, or plastic, e.g., nylon or polypropylene, or any other suitable material.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

What is claimed is:

1. A chair comprising
a seat;
a backrest;
a first armrest;
a second armrest;
a seat support structure;
means for supporting the lower back of a seated person;
a first slider;
a second slider;
a first slideway having a plurality of cavities; and
a second slideway having a plurality of cavities; wherein,
said means for supporting the lower back of a seated person is spaced from said backrest and said seat;
said first slider and said second slider are disposed at two opposite ends of said means for supporting the lower back of a seated person;
said first slideway is cooperating with said first slider and is connected to said first armrest;
said second slideway is cooperating with said second slider and is connected to said second armrest;
said first slider and said second slider comprise each a block capable of sliding along said slideways,
a pair of protrusions is disposed at two opposite sides of said block, and
a through hole and a fixing hole are oppositely formed in said block between said protrusions.

2. The chair of claim 1, wherein a pair of grooves for movably receiving said protrusions is disposed on two opposite sides of said slideways.

3. The chair of claim 2, wherein a gap for allowing each of the sliders to be detached from the first and the second armrests is disposed at a front end of each said groove.

4. The chair of claim 1, wherein said slider further comprises a controlling portion for controlling said block, said controlling portion comprising a bolt; a dowel extending from said bolt; and a tilting member connected to said bolt.

5. The chair of claim 4, wherein said dowel is inserted into said through hole on said block, and further into said cavities on said armrests.

6. The chair of claim 4, wherein said slider further comprises a spring, an upper cover and a pressing portion, all of which cooperate with said controlling portion to allow said means of support to be moved towards said backrest and away from said backrest; and said spring is mechanically-connected between said controlling portion and said upper cover.

7. The chair of claim 6, wherein an opening is disposed on said upper cover for receiving said tilting member and/or said pressing portion.

8. The chair of claim 7, wherein one side of said pressing portion abuts against said tilting member via said spring.

9. The chair of claim 6, wherein said slider further comprises a driving portion disposed at the other side of said pressing portion.

10. The chair of claim 9, wherein said driving portion comprises a metal sleeve abutting against said pressing portion; and a rope sleeve movably mounted on said metal sleeve and mechanically-connected to said support element.

11. The chair of claim 10, wherein said driving portion further comprises a screw traversing through said metal sleeve, said pressing portion, said upper cover and said control portion.

12. The chair of claim 1, wherein said armrests further comprise inclined planes disposed on said slideways in proximity of said cavities, said inclined planes preventing said sliders from moving backwardly unless said pressing portion is depressed.

13. The chair of claim 1, wherein said first slider is movably connected to said first slideway and said second slider is movably connected to said second slideway.

14. The chair of claim 1, wherein said means for supporting the lower back of a seated person is a flexible support element capable of being moved with respect to said first and/or said second armrest.

* * * * *